United States Patent [19]

Paul

[11] Patent Number: 4,813,444

[45] Date of Patent: Mar. 21, 1989

[54] VALVE FOR SPREAD SET PLUMBING FIXTURE AND METHOD OF INSTALLATION

[75] Inventor: Stanley M. Paul, Rye, N.Y.

[73] Assignee: Paul Associates, Inc., Long Island City, N.Y.

[21] Appl. No.: 116,530

[22] Filed: Nov. 3, 1987

[51] Int. Cl.[4] ..... F16K 43/00; F16K 51/00

[52] U.S. Cl. ..... 137/15; 137/315; 137/454.5; 137/625.31; 251/208; 251/304

[58] Field of Search ..... 137/15, 315, 454.2, 137/454.5, 454.6, 625.31, 437; 251/205, 208, 304, 316

[56] References Cited

U.S. PATENT DOCUMENTS

| | | | |
|---|---|---|---|
| 1,629,914 | 5/1927 | Haas | 137/437 |
| 1,753,535 | 4/1930 | Schimmel | 137/625.31 |
| 2,667,179 | 1/1954 | Bennett | 137/437 |
| 2,827,073 | 3/1958 | Owens | 137/437 |
| 2,935,293 | 5/1960 | Monson | 137/625.31 |
| 3,581,752 | 6/1971 | Schoepe et al. | 137/437 |
| 3,831,621 | 8/1974 | Anthony et al. | 137/625.31 |
| 3,834,416 | 9/1974 | Parkison | 137/625.31 |
| 4,331,176 | 5/1982 | Parkison | 137/454.6 |

FOREIGN PATENT DOCUMENTS

| | | | |
|---|---|---|---|
| 659779 | 3/1963 | United Kingdom | 137/454.6 |

*Primary Examiner*—George L. Walton
*Attorney, Agent, or Firm*—Darby & Darby

[57] ABSTRACT

A valve assembly is disclosed for use with a spread set plumbing fixture wherein a casing is to be secured to a mounting surface in a precise, predetermined spatial relationship to a handle.

5 Claims, 1 Drawing Sheet

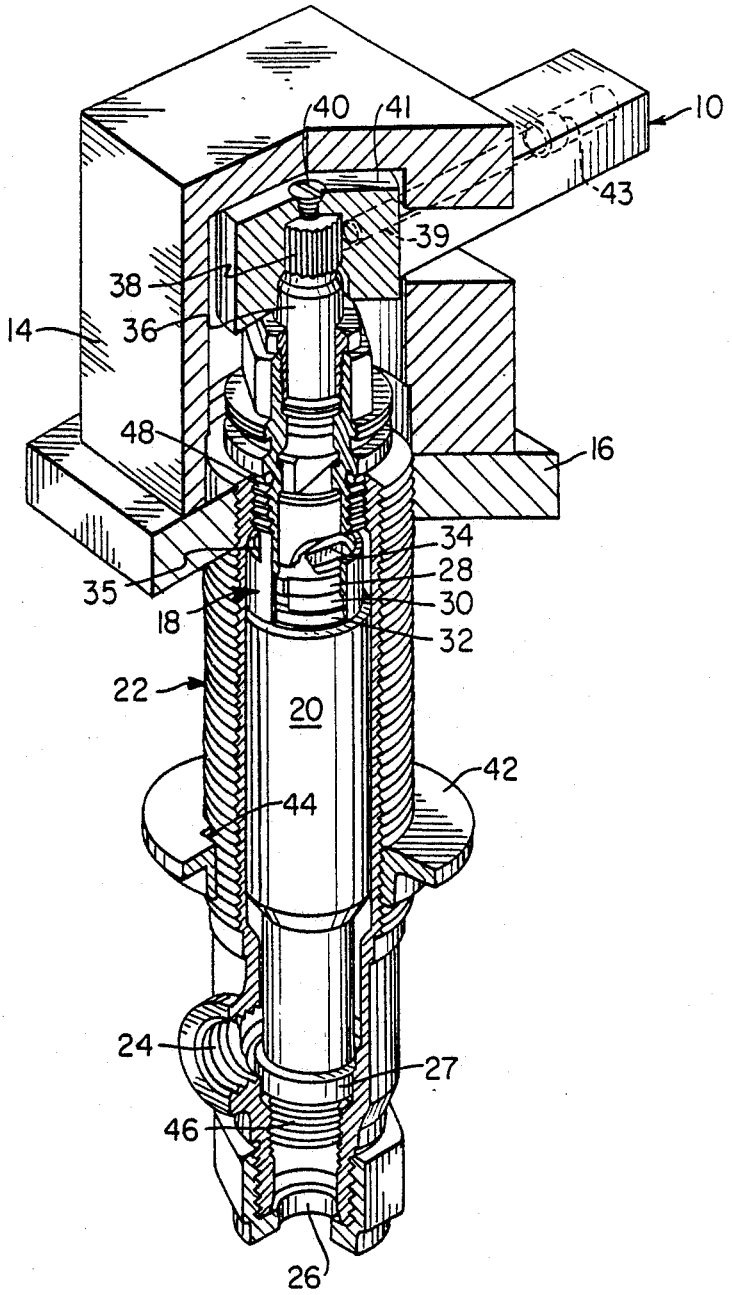
10
40
41
43
39
38
36
14
48
16
34
28
35
30
18
32
22
20
42
44
24
27
46
26

VALVE FOR SPREAD SET PLUMBING FIXTURE AND METHOD OF INSTALLATION

This invention relates to plumbing fixtures. More particularly this invention relates to a valve assembly of the type used with spread set plumbing fixtures.

Lavatory plumbing fixtures typically are sold as single sets or assemblies known as spread sets. A single set includes the spout and hot and cold water valves as a single unit. A spread set includes separate units for each of the hot and cold water valves and the spout, i.e., a total of three separate units.

Because all of the connections between the valves and the spout are internal in the case of a single set fixture, single set fixtures are commonly installed from the top; i.e., after a suitable hole has been formed in a counter or other mounting surface, the fixture is dropped through the top and connected to the incoming hoses. Generally, it is preferable to insert a fitting such as a valve or spout from the top since installation is easier for the plumber.

In the case of a spread set, the spout is inserted from the top but because of the need to interconnect the valves and the spout after installation, the construction of the valve bodies is such that installation from the top is not practical. In many cases, this is merely a minor inconvenience since the valve casing and handle can be readily connected to the valve after the valve has been inserted from the bottom. However, in the case of certain types of valves where the spacing of the handle relative to the casing (or some other part) is relatively critical, the prior art constructions have resulted in greatly increased installation times and, therefore, installation costs.

As one example, if the handle of the valve is to move in a horizontal slot within a casing between open and closed positions, it can prove to be exceedingly tedious and time consuming for the plumber to first insert the valve body from the bottom and then attempt to adjust the height of the handle relative to the casing so that the handle moves smoothly within the casing slot between the proper open and closed valve positions.

It is an object of the present invention to provide a valve construction intended specifically for use with spread set plumbing fixtures wherein the position of the valve handle relative to its casing is critical, which can be delivered to the plumber in an assembled state so that it can be inserted through an opening in a mounting surface from the top.

SUMMARY OF THE INVENTION

In accordance with the invention, a valve body comprises an upwardly extending stem and inlet and outlet ports at its lower end. The stem is connected to a handle after a casing has been attached to the valve body. The valve body is threaded and adapted to receive a flange nut which is constructed so that it can be slipped over the inlet and outlet ports from underneath so that it can be tightened on the valve body to secure the casing and thus the entire valve to the mounting surface.

THE DRAWINGS

The single figure is a partially broken away perspective view of a preferred embodiment of the invention.

DETAILED DESCRIPTION

The drawing is a perspective view showing a construction with which the invention is particularly useful. In this case, the plumbing fixture comprises a handle 10 rotatable within a slot 12 of a cube like casing 14. Casing 14 terminates in an escutcheon 16 which rests on the counter or basin on which the fitting is to be mounted.

With this type of fitting, i.e., where a handle rotates within a slot in a casing, the handle must be properly aligned with respect to the casing. If it is not, movement of the handle is likely to be hindered by contact with a surface of the casing defining the slot. The handle of course is attached to the valve so that the valve can be opened and closed. With the prior art constructions typically used for spread set fittings, it is very difficult and time consuming to attach the casing and handle to the valve body and valve stem after the valve body has been secured to a mounting surface. In accordance with the invention, this problem is entirely eliminated by providing for a construction in which the handle and casing can be preassembled to the valve body and the construction installed from the top.

In a preferred embodiment, the valve comprises a $\frac{1}{4}$ turn ceramic cartridge with oxide ceramic discs. By way of example, a cartridge suitable for use in accordance with the invention is manufactured by Fluhs Prehtechnik Gmbh of Ludenscheid, West Germany. This device is illustrated in the drawing and, since it is a commercially available device, it is described generally without reference to specific detail.

The valve comprises a cartridge assembly 18 which rests on an elongated cylindrical seat 20. The cartridge assembly 18 and seat 20 are retained within a partially threaded cylindrical valve body 22 with a space of $\frac{1}{8}$ inch (for example) between the outer diameter of seat 20 and the inner diameter of value body 22. Valve body 22 includes a short transverse outlet port 24 and an axial inlet port 26 at its lower end. Ports 24 and 26 may be threaded internally so that they can be connected to fittings and hoses for conducting water to and from the valve. A washer 27 prevents direct water flow from inlet part 26 to outlet part 24.

Cartridge assembly 18 includes ceramic discs 28 and 30 and a seal in the form of an annular washer 32. The discs each include two "butterfly" openings, of which one is shown at 34. When the openings are aligned, the valve is "open" and water flows from the inlet port 26 to the outlet port 24 through a radial slot 35 as will be described further below. The upper disc 28 is connected to a stem 36 which terminates in a pinion 38. The handle 10 is secured to a hub 41 which is attached to pinion 38 by means of a machine screw 40. The hub 41 includes a threaded hole 39 in its peripheral wall which receives an elongated machine screw 43 extending longitudinally through handle 10 so that the handle can be attached to the hub.

When handle 10 is turned, moving disc 28 to align the butterfly openings 34, water from the inlet port 26 passes through a pipe (not illustrated) extending axially through cylindrical seat 20 and through the opening formed by the aligned openings 34. The water flows from the cartridge assembly 18 through radial slot 35 downwardly through the space between the outer surface of seat 20 and the inner surface of valve body 22, and finally through the outlet port 24.

A threaded flange nut 42 is screwed onto the outside threaded surface of the valve body 22. In accordance with the invention, flange nut 42 includes a cut-out section 44 which enables the flange nut 42 to be inserted over the outlet port 24.

To assemble the device, cylindrical seat 20 is first screwed into the valve body 22 by means of the threaded portion 46. The cartridge assembly 18 is then screwed into the upper portion of the valve body 22 by means of the threaded portion 48 and tightened until the washer 32 provides a watertight seal. Hub 41 is then attached to pinion 38 by screw 40. The casing 14 is secured to escutcheon 16 (by screws or the like) and the casing and escutcheon threaded onto the valve body 22 until the threaded hole 39 within hub 41 is centered within the slot. At this position, with the valve in either its open or closed position, handle 10 can be attached to the hub 41 by means of the elongated screw 43.

Installation by the plumber is very simple. With flange nut 42 removed, the plumber cuts a hole in the mounting surface large enough to receive the valve body 22. Since the outlet port 24 is short it can pass easily through this hole so that the plumber can simply drop the entire assembly through the hole and then secure flange nut 42 to the under surface of the basin or counter on which the valve is mounted. The other valve and spout are likewise installed and then the connecting hoses are hooked up between the spout and the valves to complete the installation. In this way, the problem of aligning the handle and casing as would be required for conventional spread set assemblies in which the valve body is installed from the bottom, is completely eliminated.

What is claimed is:

1. A valve assembly for use with a spread set plumbing fixture, comprising a valve body having an elongated inner element with an inlet port, an elongated outer element with an outlet port and an external threaded portion above said ports, a stem extending upwardly from the valve body, a handle secured to said stem, and a casing secured to the outer surface of said valve body in a predetermined spatial relationship to said handle, said elongated inner element being radially inside of said elongated outer element so as to define a space therebetween, whereby rotation of the handle relative to the casing and valve body causes the valve to selectively open and close to respectively allow and stop water flow from said inlet port through said space to said outlet port, the external threaded portion being formed so that a flange securing means is threadably engageable on said external threaded portion of said valve body for securing said valve body to said casing while the shape of said flange securing means being such that the flange securing means can be passed over the inlet and outlet ports to allow for easy installation of said valve body as a single unit.

2. A valve assembly according to claim 1, wherein said flange securing means is a flange nut threadably engaging said external threaded portion of said valve body.

3. A valve assembly according to claim 2, wherein said flange nut includes a cut-out section to allow the flange nut to be passed over the outlet port.

4. A valve assembly according to claim 2 or 3, wherein said casing includes a horizontal slot and said handle extends through and is rotatable in said slot.

5. A method of installing a valve in a spread set plumbing fixture, comprising first procuring a valve body having secured thereto a casing and a handle in a precise predetermined spatial relationship, the handle adapted to open and close the valve, and the valve body including inlet and outlet ports beneath a threaded portion, then inserting the valve body through a hole in a mounting surface from above the mounting surface until the bottom of the casing rests on the mounting surface, and then inserting a flange nut from beneath the mounting surface over the inlet port and outlet port into threaded engagement with the threaded portion of the valve body, and tightening said flange nut against the undersurface of said mounting surface to allow for easy installation of said valve body as a single unit.

* * * * *